United States Patent [19]

Tanaka

[11] Patent Number: 4,781,551

[45] Date of Patent: Nov. 1, 1988

[54] ROTARY COMPRESSOR WITH LOW-PRESSURE AND HIGH-PRESSURE GAS CUT-OFF VALVES

[75] Inventor: Yasuhiko Tanaka, Nara, Japan

[73] Assignee: Matsushita Refrigeration Company, Osaka, Japan

[21] Appl. No.: 879,888

[22] Filed: Jun. 30, 1986

[51] Int. Cl.[4] ..... F04C 18/356; F04C 25/00; F16K 31/12; F25B 49/00

[52] U.S. Cl. ..... 418/63; 418/270; 62/228.1; 137/509

[58] Field of Search ..... 418/63–67, 418/270; 417/902; 62/228.1; 137/509, 315, 316

[56] References Cited

U.S. PATENT DOCUMENTS

| | | | |
|---|---|---|---|
| 2,961,147 | 11/1960 | Osterkamp | 417/295 |
| 4,522,038 | 6/1985 | Ozu | 62/228.5 |

FOREIGN PATENT DOCUMENTS

| | | | |
|---|---|---|---|
| 859897 | 12/1952 | Fed. Rep. of Germany . | |
| 1204773 | 2/1957 | Fed. Rep. of Germany . | |
| 2409270 | 10/1974 | Fed. Rep. of Germany . | |
| 57-200697 | 12/1982 | Japan . | |
| 58-98692 | 6/1983 | Japan . | |
| 58-98693 | 6/1983 | Japan . | |
| 58-96196 | 6/1983 | Japan . | |
| 58-96195 | 6/1983 | Japan . | |
| 60-190688 | 9/1985 | Japan | 418/270 |
| 60-190689 | 9/1985 | Japan | 418/270 |
| 60-219492 | 11/1985 | Japan | 418/270 |
| 2122325 | 1/1984 | United Kingdom . | |

*Primary Examiner*—John J. Vrablik

*Attorney, Agent, or Firm*—Stevens, Davis, Miller & Mosher

[57] ABSTRACT

A rotary compressor for use with refrigerating apparatuses such as freezing refrigerators, freezers, showcases for household or commercial use incorporates a mechanism in a compressor unit. When a space to be freezed is freezed in a on-off operation mode, the mechanism prevents a large amount of high temperature refrigerant gas in a closed casing of the compressor from being discharged to an evaporator during the suspension of the operation of the compressor.

11 Claims, 4 Drawing Sheets

ROTARY COMPRESSOR WITH LOW-PRESSURE AND HIGH-PRESSURE GAS CUT-OFF VALVES

BACKGROUND OF THE INVENTION

1. Field of the Invention

The present invention relates to a rotary compressor for use in a refrigerating apparatus.

2. Description of the Prior Art

In prior refrigerating apparatus, it is common for a high temperature and high pressure gas in a closed casing of a compressor to flow into an evaporator which is maintained at a low pressure in a refrigerating system when the operation of a rotary compressor is suspended, thereby increasing the heat load on the refrigerating apparatus. Therefore, Japanese Patent Application No. 86447/1981 has proposed a rotary compressor which incorporates a valve mechanism for cutting off flow of low-pressure and high-pressure gas and designed to open during the operation of the rotary compressor and close during the suspension of the rotary compressor, thereby attaining reduction in the heat loss generated during the suspension of the rotary compressor.

In a rotary compressor of the invention of the above-mentioned application, a slide valve acting as a valve for cutting off flow of high-pressure gas is provided at a portion of a cylinder plate which constitutes a compression element of the rotary compressor, and an inlet port adapted to be opened and closed by means of a piston-like slider is connected at its one end to a closed casing and an outlet port is connected to a discharge pipe which extends through the closed casing. The rotary compressor of this type also includes a reed valve type check valve which serves as a valve for cutting off flow of low-pressure gas, and is disposed between a suction pipe and a cylinder. In the thus-arranged rotary compressor, the high-pressure and low-pressure gas cut-off valves are both closed when the operation of the compressor is suspended, so that the high-temperature and high-pressure gas in the closed casing is prevented from flowing into the evaporator through the condenser to cause any increase in the heat load of the refrigerating apparatus. As the compressor is operated, pressure difference between the closed casing and the cylinder actuates the slider to communicate the inlet port with the outlet port, and to open the high pressure cut-off valve, thereby feeding pressurized gases to the condenser. The low-pressure gas cut-off valve is open by this time to afford a normal cooling operation.

The rotary compressors of the prior art suffer from a problem in that since the high-pressure gas cut-off valve is of a slide valve type, there is a limit to its anti-leakage performance when closed. In order to attain an improved anti-leakage performance, the clearance between the slide valve and a valve cylinder in which the slide valve moves must be maintained at a minimal value. However, this requires improved work accuracy and increases the cost of machining and assembly work such as matching assembly.

Further, foreign matters such as abrasion powder generated by the rotating and sliding portions of the rotary compressor during its operation may enter the clearance, generating an hydraulic lock which may lead to disabled operation of the rotary compressor.

In case an effective pressure surface of a spool valve is increased so as to reduce the pressure difference required at the time of starting, a larger space is required to enable mounting a high-pressure gas cut-off valve, and noise may be generated during the operation due to the increased weight of the rotary compressor.

SUMMARY OF THE INVENTION

Accordingly, an object of the present invention is to provide a rotary compressor which is improved in anti-leakage performance when flow of a high-pressure gas is cut off, and which permits cut-off of flow of a high-pressure gas at a low cost by employing a disc-type valve.

A further object of the present invention is to provide a rotary compressor having a high pressure gas cut-off valve, of which inlet and outlet ports are arranged to afford positive operation with small pressure differences and eliminate reduction of the clearances.

A still further object of the present invention is to provide a rotary compressor having a compact construction in which a high pressure gas cut-off valve is incorporated in a compression element of a compressor.

A further object of the present invention is to provide a rotary compressor having an arrangement of inlet and outlet ports which can reduce an amount of lap associated with a high pressure gas cut-off valve and the outlet port in spite of dispersion produced during assembly, and having a high pressure gas cut-off valve which is accommodated in a limited space and has a small pressure loss.

A further object of the present invention is to provide a rotary compressor in which a collar-like member is used to improve an efficiency of assembling operation for a high pressure gas cut-off valve.

Another object of the present invention is to provide a rotary compressor in which an efficiency of assembling operation for a low pressure gas cut-off valve having a bias spring is improved.

DESCRIPTION OF THE PREFERRED EMBODIMENTS

An embodiment of the present invention will be hereinunder described with reference to the accompanying drawings.

Figure 1:
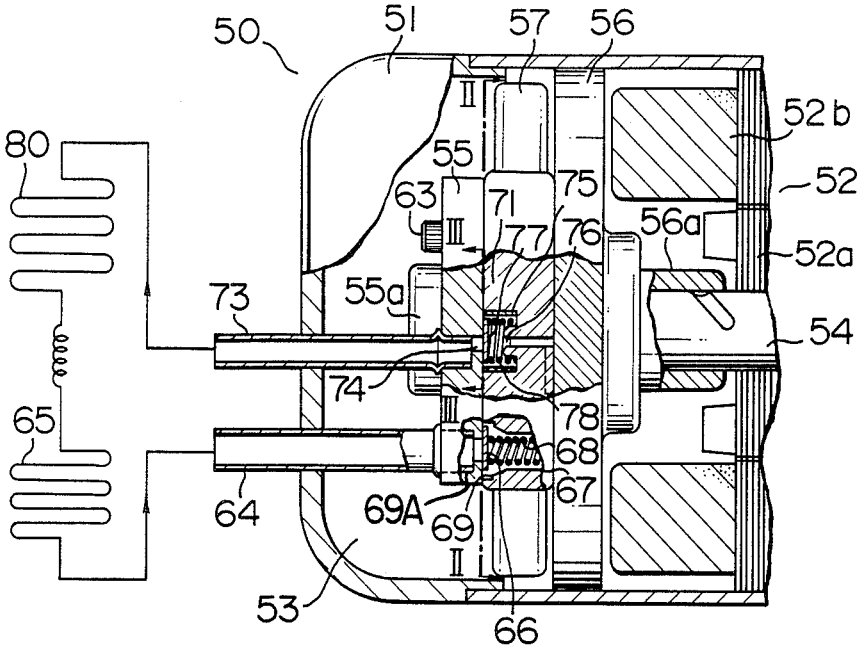
FIG. 1 is a cross-sectional view of a rotary compressor according to an embodiment of the present invention.
Figure 2:
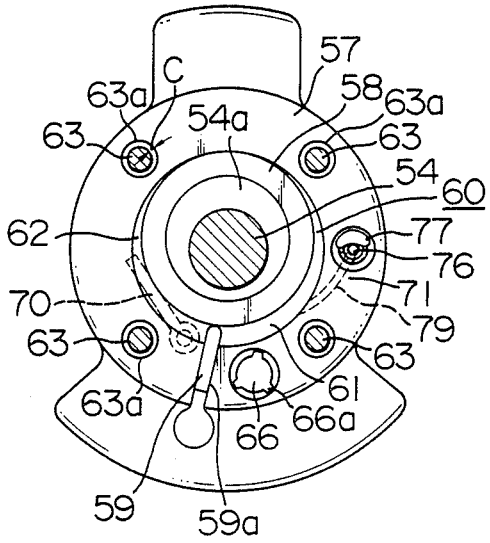
FIGS. 2 and 3 are sectional views taken along the lines II—II and III—III of FIG. 1, respectively.

Referring first to FIGS. 1 and 2, reference numeral 50 designates a rotary compressor which includes a closed vessel 51, an electrically driven element 52 having a rotor 52*a* and a stator 52*b*, and a compression element 53. Reference numeral 54 denotes a crankshaft press fitted on the rotor 52*a* to extend substantially in the horizontal direction, and rotatably supported by bearing portions 55*a* and 56*a* formed in side plates 55 and 56, respectively. A cylinder plate 57 rotatably supports a rotor 58 mounted on an eccentric portion 54*a* of the crankshaft 54. A compression chamber 60 defined by the outer periphery of the rotor 58, the inner periphery of the cylinder plate 57 and the side plates 55 and 56 is divided into a low-pressure chamber 61 and a high-pressure chamber 62 by a vane 59. Reference numeral 59*a* indicates a vane groove. The side plates 55 and 56 and the cylinder plate 57 are secured in a laminated state by bolts 63. Each bolt 63 is inserted in a bolt hole 63*a* with clearance C provided therebetween, so that the side plate 55 is allowed to move slightly in its circumferential direction. A suction pipe 64 for introducing a refrigerant gas from an evaporator 65 to the compression chamber 60 is secured in a press-fit bore 69*a* provided in the side plate 55. The end surface of the press-fit bore 69*a* which faces the cylinder plate 57 constitutes a valve seat for a disc-shaped low-pressure gas cut-off valve 66 which has three leg pieces 66*a*. The low-pressure gas cut-off valve 66 is accommodated in a suction passage 67 which is communicated to the pressfit bore 69*a* and is located adjacent to the vane 59, and which communicates with the compression chamber 60 and a bias spring 68 is accommodated in the suction passage 67 for applying a small force on the valve to maintain the same in a closed position. A stepped portion 69 is provided to limit the movement of the valve 66 when it is opened.

Figure 8:
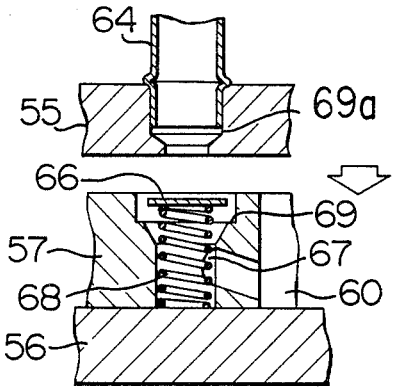
FIG. 8 is an exploded sectional view of a low-pressure gas cut-off valve, illustrating how it is assembled.

As shown in FIG. 8, the natural length of the bias spring 68 is sized such that when the bias spring 68 and the low pressure gas cut-off valve 66 are mounted from above with the cylinder plate 57 and the side plate 56 secured to each other beforehand, the respective surfaces of the cylinder plate 57 of the valve 66 becomes substantially flush with one another so as not to cause the low pressure gas cut-off valve 66 to extend beyond the top surface of the cylinder plate 57.

Figure 3:
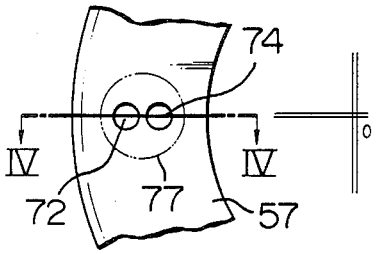
Figure 4:
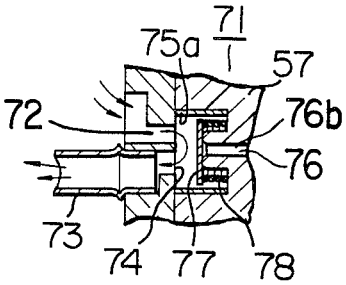
FIG. 4 is a sectional views taken along the line IV—IV of FIG. 3.
Figure 5:
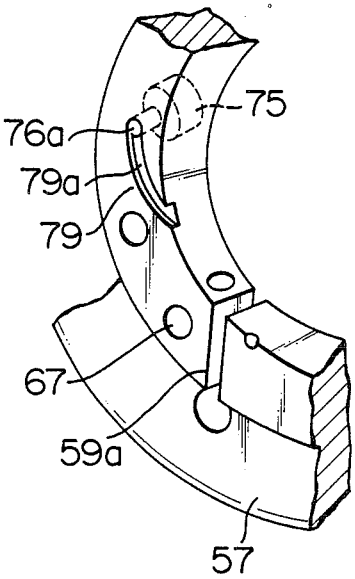
FIG. 5 is a perspective view of an essential part of a cylinder plate.
Figure 9:
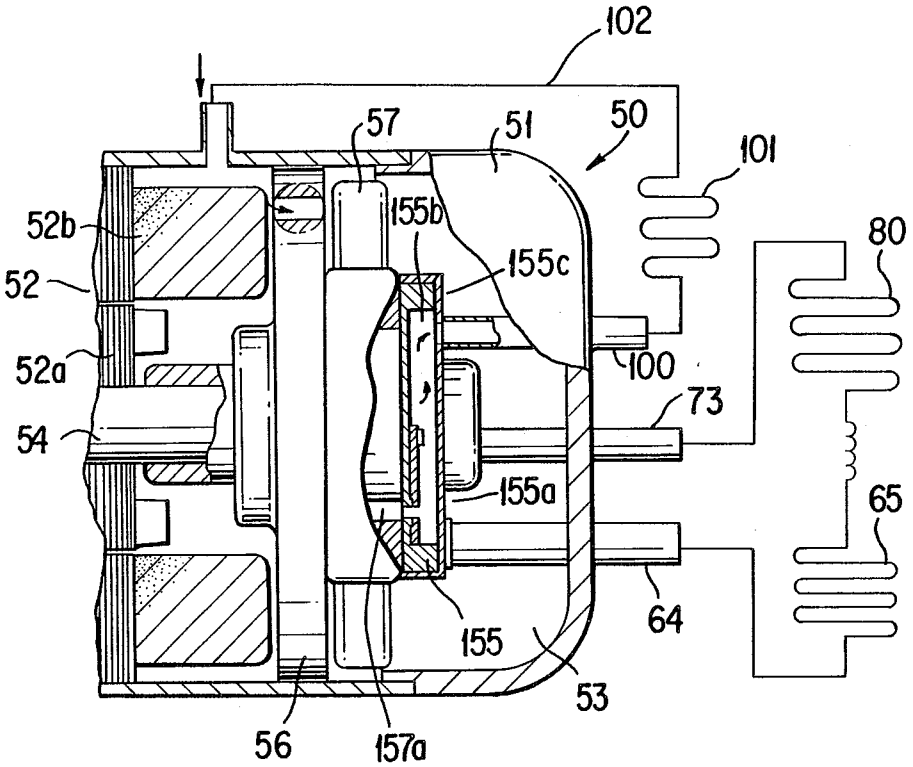
FIG. 9 shows a rotary compressor which is provided with a pre-cooler pipe and into which a mechanism is incorporated for preventing a high temperature refrigerant gas from flowing into the condenser during the suspension of the rotary compressor.

Reference numeral 70 designates a discharge valve for introducing the refrigerant gas, which has been compressed in the compression chamber 60 directly or through the intermediary of a precooler pipe as shown in FIG. 9, into the closed vessel 51 (see FIG. 2). A high-pressure gas cut-off valve unit 71 is disposed at substantially the same level as that of the crankshaft 54, and includes a high-pressure side inlet port 72 provided in the side plate 55 to extend in the axial direction of the crankshaft 54, and a high-pressure side outlet port 74 connected to a discharge pipe 73 which extends through the closed vessel 51. The inlet and outlet ports 72 and 74, as shown in FIGS. 3 and 4, are aligned side by side in the normal direction of the cylinder plate 57 such that the outlet port 74 is disposed inside and the inlet port 72 is disposed outside. The symbol o shown in FIG. 3 represents the center of the crankshaft. In the cylinder plate 57 is provided a valve cylinder 75 which is common to and corresponds with the adjacent, respective ports 72, 74, and which is provided at its bottom with a low pressure side port 76. One end surface of a disc-shaped circular high-pressure valve 77 is capable of closing both the inlet and outlet ports 72 and 74, while the other end surface thereof is capable of closing a valve seat 76*b* of the low-pressure side port 76. Reference numeral 78 designates a bias spring which serves to constantly bias valve 77 to the high pressure side inlet and outlet ports 72, 74 toward the closed position.

Figure 6:
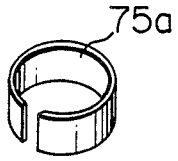
FIG. 6 is a perspective view of a collar.
Figure 7:
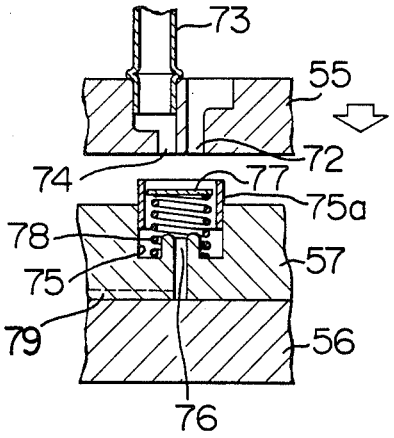
FIG. 7 is an exploded sectional view of a high-pressure gas cut-off valve, illustrating how it is assembled.

A collar 75*a* is placed inside the valve cylinder 75, and is cylindrical and has a C-shaped cross-section, as shown in FIG. 6. Since the collar 75*a* has a resilient force tending to expand the collar outward, it can be held with only its lower portion received in the valve cylinder 75, as shown in FIG. 7. When assembling the high-pressure valve 77, the bias spring 78 and the high-pressure valve 77 are inserted in the collar 75*a* in that order, and the collar 75*a* is then sunk into the valve cylinder 75 by mounting the side plate 55 on the cylinder plate 57. The low-pressure side port 76 is communicated with the low-pressure chamber 61 of the compression chamber 60 through a pressure passage 79. A channel 79*a* is mechanically machined or formed by sintering on one end surface of the cylinder plate 57, and is closed by the side plate 56 to constitute the pressure passage 79.

Although not shown here, a channel may be alternatively machined on the side plate 56 and then closed by the cylinder plate 57 to constitute the pressure passage. In such a case, the low-pressure port 76 must of course communicate with the pressure passage. A pressure passage may also be directly drilled in the cylinder plate 57.

The operation of the rotary compressor arranged in the above described manner will now be described below.

When the operation of the rotary compressor is suspended, as shown in FIG. 1, the low-pressure gas cut-off valve 66 acting as a check valve is closed, and the high-pressure gas cut-off valve 77 closes both the high-pressure side inlet and outlet ports 72 and 74. The high-pressure gas cut-off valve 77 is closed by virtue of the difference in pressure generated at the upstream and downstream sides of the high-pressure side outlet port 74, i.e., the difference between the condensing saturation pressure at the temperature of the cooling chamber containing the evaporator 65 and the saturation pressure at the temperature of the closed vessel 51, as well as by the slight amount of force of the bias spring 78.

Therefore, the high-temperature and high-pressure gas contained in the closed vessel 51 is prevented from flowing into the coddenser 80 and evaporator 65, thereby reducing the heat load on the evaporator 65.

When the operation of the rotary compressor is started and the electrically driven element 52 is electrically energized, the crankshaft 54 is rotated so as to cause gas pressure drop in the low-pressure chamber 61 of the compression chamber 60. This pressure drop is produced positively in a very short period of time despite the relatively loose clearance (amounting to about 0.1 to 0.2 mm) provided between the high-pressure gas cut-off valve 77 and the collar 75*a* mounted inside of the valve cylinder 75, since the high-pressure side inlet port 72 is closed. This pressure drop naturally leads to pressure drop in the pressure passage 79, the low-pressure side port 76 and the valve cylinder 75, so that pressure difference between the pressure in the high pressure side inlet port 72, hence in the closed vessel 51 and the pressure in the valve cylinder 75 is applied on the high pressure gas cut-off valve 77 to separate the same from the high pressure side outlet port 72, to which the valve 77 has strongly adhered. The high-pressure gas cut-off valve 77, after the initial separation thereof from the high-pressure side outlet port 72, then closes the low-pressure side port 76 against the resilient force of the bias spring 78 with the aid of the dynamic pressure of the gas flow as well as this pressure difference. Such closed position of the low pressure side port 76 is maintained during the operation of the compressor 50 by pressure difference between the high pressure in the closed vessel 51 and the low pressure in the low pressure chamber 61. At this time, the high-pressure side inlet and outlet ports 72 and 74 communicate with each other, so that the high-pressure refrigerant gas flows from the closed vessel 51 to the condenser 80. On the other hand, the low-pressure gas cut-off valve 66 is also opened to afford a normal cooling operation.

When the operation of the rotary compressor is suspended and the crankshaft 54 stops its rotation, the flow of gases through the suction pipe 64 is stopped, so that the suction gas cut-off valve 66 is closed by the bias force of the bias spring 68. The oil seal which divides the compression chamber 60 into the high-pressure and low-pressure chambers 62 and 61 is also broken, so that the high-pressure gas in the closed vessel 51 builds pressure in the low-pressure chamber 61 through, for example, the clearance between the vane 59 and the vane groove 59*a*. This action eventually extends to the low-pressure port 76 through the pressure passage 79. Such extent of rise in pressure is attained in a relatively short period of time (for example, about 10 to 20 seconds) since the pressure passage 79 can be made small in volume. As the gas pressures in the low-pressure side port 76 and in the closed vessel 51 becomes substantially equal to each other, the high-pressure gas cut-off valve 77 is separated from the low-pressure side port 76 by means of the resilient force of the bias spring 78 to close both the high-pressure side inlet and outlet ports 72 and 74.

In consequence, during the suspension of the operation of the rotary compressor, the high-temperature and high-pressure gas contained in the closed vessel 51 is prevented from flowing into the condenser 80 and the evaporator 65.

In addition, since the high-pressure side inlet and outlet ports 72 and 74 are arranged side by side in the normal direction of the cylinder plate 57, the change which occurs in the amount by which the high-pressure gas cut-off valve 77 overlaps the ports 72 and 74 can be reduced remarkably even if the cylinder plate 57 is radially moved during the assembly as compared with the case in which the inlet and outlet ports 72 and 74 were arranged side by side in the circumferential direction of the plate 57.

When, as shown in FIG. 9, a pre-cooler pipe 101 is used in the invention, a high-pressure refrigerant gas flows into a valve 155*a* from a discharge port 157*a* formed on the cylinder plate 57, which valve 155*a* is provided in a recess 155*b* formed in a side platae 155. The recess 155*b* is covered by a cover 155*c* and is connected to pre-cooler pipe 101 outside of the vessel 51 through a discharge pipe 100 secured to the cover 155*c*. The pre-cooler pipe 101 is connected to the vessel 51 through an inlet pipe 102 to return a high-pressure refrigerant gas to the interior of vessel 51. The process in which the high-pressure refrigerant gas returns to the condenser 80 through the discharge pipe 73 is performed in the same manner as shown in FIG. 1.

Assembly of the compression element 53 will be described below with reference to FIGS. 7 and 8. The compression element 53 is assembled by successively placing on the side plate 56 the cylinder plate 57 and the side plate 55.

At this time, the natural length of the bias spring 68 of the low-pressure gas cut-off valve 66 is sized that the low-pressure gas cut-off valve 66 does not extend beyond the upper surface of the cylinder plate 57 when set on the bias spring 68. On the other hand, the high-pressure gas cut-off valve 77 is first assembled by setting the collar 75*a* in the valve cylinder 75 with its upper portion extending beyond the upper surface of the cylinder plate 57 and then inserting in the collar 75*a* the bias spring 78 and the high-pressure gas cut-off valve 77. The high-pressure gas cut-off valve 77 can be prevented from moving in the collar 75*a* by the presence of the bias spring 78 which requires to be preloaded. The side plate 55 is then placed on the cylinder plate 57 from above to complete the assembly of the collar 75*a*, high-pressure gas cut-off valve 77 and bias spring 78.

I claim:

1. A rotary compressor with low-pressure and high-pressure gas cut-off valves comprising: a closed vessel; a compression element; and a electrically driven element, said compression element and said electrically driven element being accommodated in said closed vessel, said compression element comprising two side plaste each having a bearing portion for supporting a crankshaft; a cylinder plate for rotatably accommodating a rotor, said side plates and said cylinder plate being laminated to constitute a compression chamber; a vane and an oil seal for dividing said compression chamber into a low-pressure chamber and a high-pressure chamber, said vane having an end contacting an outer periphery of said rotor, said vane being accommodated in a vane groove of the cylinder plate and being biased toward said rotor by a spring; a low-pressure gas cut-off valve acting as a check valve which communicates with said low-pressure chamber and is disposed adjacent to said vane; a discharge valve for introducing a refrigerant gas into the closed vessel, which has been compressed in the compression chamber, directly or through an intermediary of a pre-cooler pipe; a high-pressure side inlet port in open communication with said closed vessel and a valve cylinder; a high-pressure side outlet port in open communication with a discharge pipe and said valve cylinder, said discharge pipe extending through said closed vessel; said high-pressure side inlet port and said high-pressure side outlet port being in juxtaposition with each other on the same surface of the side plate; a low-pressure side port in direct open communication with said valve cylinder and said low-pressure chamber of said compression chamber through a pressure passage; and a high-pressure gas cut-off valve in said valve cylinder, of which a flat surface thereof is capable of closing both said high-pressure side inlet and outlet ports simultaneously and of which the other end surface is capable of closing said low-pressure side port.

2. A rotary compressor according to claim 1, wherein said low-pressure side port is formed in said cylinder plate.

3. The rotary compressor according to claim 2, wherein said high-pressure side inlet and outlet ports are arranged side by side substantially in the normal direction.

4. The rotary compressor according to claim 2, wherin said pressure passage is constituted by a channel which is communicated at its one end to said low pressure port and is formed on the interface of said cylinder plate and said side plate.

5. The rotary compressor according to claim 1, wherein said crankshaft is disposed substantially in the horizontal direction, and said low-pressure valve is provided with a bias spring.

6. The rotary compressor according to claim 5, wherein the natural length of said bias spring is sized such that said low-pressure gas cut-off valve does not extend beyond the end surface of said cylinder plate.

7. A rotary compressor with low-pressure and high-pressure gas cut-off valves comprising; a closed vessel; a compression element; and an electrically driven element, said compression element and said electrically driven element being accommodated in said closed vessel, said compression element comprising two side plates each having a bearing portion for supporting a crankshaft; a cylinder plate for rotatably accommodating a rotor, said side plates and said cylinder plate being laminated to constitute a compression chamber; a vane and an oil seal for dividing said compression chamber into a low-pressure chamber and a high-pressure chamber, said vane having an end contacting an outer periphery of said rotor, said vane being accommodated in a vane groove of the cylinder plate and being biased toward said rotor by a spring; a low-pressure gas cut-off valve acting as a check valve which communicates with said low-pressure chamber and is disposed adjacent to said vane; a discharge valve for introducing a refrigerant gas, which has been compressed in the compression chamber, into the closed vessel, directly or through an intermediary of a pre-cooler pipe; a high-pressure side inlet port in open communication with said closed vessel and a valve cylinder; a hihg-pressure side outlet port in open communication with a discharge pipe and said valve cylinder, said discharge pipe extending through said closed vessel; said high-pressure side inlet port and said high-pressure side outlet port being in juxtaposition with each other on the same surface of the side plate; a low-pressure side port in direct open communication with said valve cylinder and said low-pressure chamber of said compression chamber through a pressure passage, and being formed in said cylinder plate; and a high-pressure gas cut-off valve in said valve cylinder of which a flat surface is capable of closing both said high-pressure side inlet and outlet ports simultaneously and of which the other end surface is capable of closing said low pressure side port; and a cylindrical collar provided on the inner side of said valve cylinder, said collar being temporarily retained to project above the end surface of said cylinder plate and then being press-fitted in position.

8. The rotary compressor with low pressure and high-pressure gas cut-off valves according to claim 7, wherein said collar has a C-shaped cross-sectional configuration.

9. The rotary compressor with low-pressure and high-pressure gas cut-off valves according to claim 1, wherein said high-pressure gas cut-off valve is disc-shaped.

10. A rotary compressor with low-pressure and high-pressure gas cut-off valves comprising:

a closed vessel;

a compression element and an electrically driven element, said electrically driven elements being accommodated in said closed vessel;

said compression element comprising two side plates each having a bearing portion for supporting a crankshaft, a cylinder plate for rotatably accommodating a rotor, said side plates and said cylinder plate being laminated to constitute a compression chamber; a vane and an oil seal for dividing said compression chamber into a low-pressure chamber and a high-pressure chamber, said vane having an end contacting an outer periphery of said rotor, said vane being accommodated in a vane groove of the cylinder plate and biased toward said rotor by a suitable spring;

a low pressure-gas cut-off valve acting as a check valve which communicates with said low-pressure chamber and is disposed adjacent to said vane;

a discharge valve for introducing a refrigerant gas into the closed vessel, which has been compressed in the compression chamber, directly or through an intemediary of a pre-coller pipe;

a high-pressure side inlet port in open communication with a discharge pipe and a valve cylinder, said discharge pipe extending through the closed vessel; and a low-pressur side port with a vlave seat formed in the bottom of said valve cylinder in direct communication with said low-pressure chamber of said compression chamber through a pressure passage; said high-pressure side inlet port and said high-pressure said outlet port being in juxtaposition with each other on the same surface of said side plate and a high-pressure gas cut-off valve in said valve cylinder, of which one end portion is capable of closing both said high-pressure said inlet and outlet ports simultaneously and of which the other end portion is capable of closing said low-pressure side valve seat when said inlet port is in open communication with said outlet port.

11. The rotary compressor with low-pressure and high-pressure gas cut-off valves according to claim 10, wherein said high-pressure gas cut-off valve is disc-shaped.

* * * * *